US011866237B2

(12) United States Patent
Narcisse et al.

(10) Patent No.: US 11,866,237 B2
(45) Date of Patent: Jan. 9, 2024

(54) PACKAGING CONTAINER SYSTEM WITH INSERTS

(71) Applicant: CCW IP LLC, Farmers Branch, TX (US)

(72) Inventors: Paul Narcisse, Little Elm, TX (US); Zak Ragsdale, Euless, TX (US); James Lee, Houston, TX (US); Eric Schaffer, Flower Mound, TX (US)

(73) Assignee: CCW IP LLC, Farmers Branch, TX (US)

( * ) Notice: Subject to any disclaimer, the term of this patent is extended or adjusted under 35 U.S.C. 154(b) by 0 days.

(21) Appl. No.: 17/658,368

(22) Filed: Apr. 7, 2022

(65) Prior Publication Data

US 2022/0324608 A1 Oct. 13, 2022

Related U.S. Application Data

(60) Provisional application No. 63/200,987, filed on Apr. 7, 2021.

(51) Int. Cl.
*B65D 5/50* (2006.01)
*B65D 5/02* (2006.01)

(52) U.S. Cl.
CPC ..... *B65D 5/5038* (2013.01); *B65D 5/0236* (2013.01)

(58) Field of Classification Search
CPC ..... B65D 5/02; B65D 5/0236; B65D 5/32; B65D 5/50; B65D 5/5028; B65D 5/5038; B65D 25/10; B65D 71/18; B65D 81/133
USPC ..... 206/427, 433, 485, 486
See application file for complete search history.

(56) References Cited

U.S. PATENT DOCUMENTS 2,807,402 A * 9/1957 Nelbach ..... B65D 5/48026 206/499
3,596,830 A * 8/1971 McFarland ..... B65D 5/5038 206/592
6,296,120 B1 * 10/2001 Danko ..... B65D 5/503 229/906
6,702,115 B1 * 3/2004 Roper ..... B65D 5/5061 206/427
8,230,997 B1 * 7/2012 McWilliams ..... B65D 5/5038 206/139

* cited by examiner

*Primary Examiner* — Bryon P Gehman
(74) *Attorney, Agent, or Firm* — Husch Blackwell LLP

(57) ABSTRACT

A packaging container for transporting multiple beverage articles is provided. The packaging container includes an outer carton and first and second insert trays. The first insert tray includes a base panel having one or more openings for receiving a lower portion of beverage article. The second insert tray includes a base panel having or more openings for receiving an intermediate portion of a beverage article and a top wall having one or more openings for receiving an upper portion of a beverage article. The openings in the first insert tray and the second insert tray are vertically aligned when the first and second insert trays are positioned within the outer carton to secure multiple beverage articles in a separated arrangement.

15 Claims, 14 Drawing Sheets

PACKAGING CONTAINER SYSTEM WITH INSERTS

CROSS-REFERENCE TO RELATED APPLICATIONS

Application claims priority to U.S. Provisional Patent Application Ser. No. 63/200,987, filed on Apr. 7, 2021, to Paul Narcisse et al., entitled "Packaging Container System with Inserts,", the entire disclosure of which is incorporated herein by reference.

BACKGROUND OF THE INVENTION

Glass bottles and similar articles that are packaged together for shipment and storage often require a configuration that allows for the bottles or similar articles to be separated and/or isolated from one another in order to prevent damage and breakage during transport. As a result, packaging containers for bottles and similar articles use added materials placed between the individual bottles and articles packed within the packaging container.

Traditional designs for such packaging containers often use complex compartments formed within the container or include complex inserts that require significant usage of excess material to fill the void space between the individual articles within the container. These traditional designs also often use materials such as molded fiber or pulp or polystyrene that reduce efficiency of material and increase packing time during the production line.

As a result, these containers are not cost effective to manufacture, lead to increased packing times, require the use of multiple different materials, and require the use of excess amounts of material. Accordingly, a need exists for a packaging container for shipping multiple bottles or similar articles in an efficient, cost-effective manner that minimizes the use of total material.

BRIEF SUMMARY OF THE INVENTION

The present invention is directed generally to a packaging container configured for holding and/or transporting one or more individual bottles, food or beverage receptacles, or similar articles. In particular, the packaging container of the present invention may be configured to secure and retain multiple articles in a segmented and fixed position to protect from damage.

According to one embodiment of the present invention, the packaging container may include an outer carton, a first insert tray, and a second insert tray, each of which may be formed from separate material blanks. The outer carton may include a bottom panel with front and rear wall panels foldably connected along the perimeter edges of the bottom panel. The outer carton may further include a cover panel foldably connected to the opposing edge of the rear panel. The outer carton may further include a plurality of end panels foldably connected to the perimeter edges of each of the bottom, front, rear, and cover panels, which along with front and rear wall panels, collectively form a perimeter sidewall of the outer carton. The outer carton may be configured from its material blank by folding the panels along their respective fold lines and then securing the folded panels together.

The first insert tray may include a base panel with a plurality of openings defined through the base panel. Each opening may be configured for receiving an article to be held within the packaging container. The first insert tray may further include longitudinal side panels foldably connected to the longitudinal perimeter edges of the base panel. The longitudinal side panels may include a sidewall panel section extending from the base panel and a bottom wall panel section connected to the opposing edge of the sidewall panel section by a fold line. The first insert tray may further include end panels foldably connected to the lateral perimeter edges of the base panel. The first insert tray may be formed from its material blank by folding the longitudinal side panels at their respective first fold lines to form the sidewall panel sections into sidewalls. The bottom wall panel sections of both longitudinal side panels may then be folded into an overlapped arrangement to form a bottom wall of the first insert tray. The end panels may then be folded relative to the base panel to fully form the first insert tray.

The second insert tray may include a base panel with a plurality of primary openings defined through the base panel. Each primary opening may be configured for receiving an article to be held within the packaging container. The second insert tray may further include longitudinal side panels foldably connected to the longitudinal perimeter edges of the base panel. The longitudinal side panels may include a sidewall panel section extending from the base panel and a top wall panel section connected to the opposing edge of the sidewall panel section by a fold line. Each top wall panel section may include a plurality of secondary openings defined therethrough and configured for receiving an article to be held within the packaging container. The second insert tray may further include end panels foldably connected to the lateral perimeter edges of the base panel. The second insert tray may be formed from its material blank by folding the longitudinal side panels at their respective first fold lines to form the sidewall panel sections into sidewalls. The top wall panel sections of both longitudinal side panels may then be folded into an overlapped arrangement to form a top wall of the second insert tray. The end panels may then be folded relative to the base panel to fully form the second insert tray.

According to one embodiment the end panels of the second insert tray may include a main panel section extending from the base panel, a first side panel section foldably connected to and extending from each longitudinal side edge of the main panel section, and a second side panel section foldably connected to and extending away from the first side panel sections. The first and second side panel sections may extend above the top wall formed by the longitudinal side panels. According to one embodiment, the second side panel sections may be positioned between two of the secondary openings defined through the top wall panel sections.

According to one embodiment, the second insert tray may include one or more locking tabs and associated receiving slots to assist in securing the second insert tray into a folded and formed configuration. According to one embodiment, the second insert tray may include a locking tab provided on each of the second side panel sections and a receiving slot defined into the top wall of the second insert tray between two of the secondary openings defined through the top wall.

The packaging container may be used by inserting the first insert tray into the interior of the outer carton and positioned adjacent to the bottom wall of the outer carton. The articles to be stored in the packaging container may then be inserted into each of the plurality of openings defined into the first insert tray. The second insert tray may then be inserted into the outer carton and onto the articles so that the articles are inserted through both the primary and secondary openings of the second insert tray.

Other aspects and advantages of the present invention will be apparent from the following detailed description of the preferred embodiments of the accompanying drawing figures.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
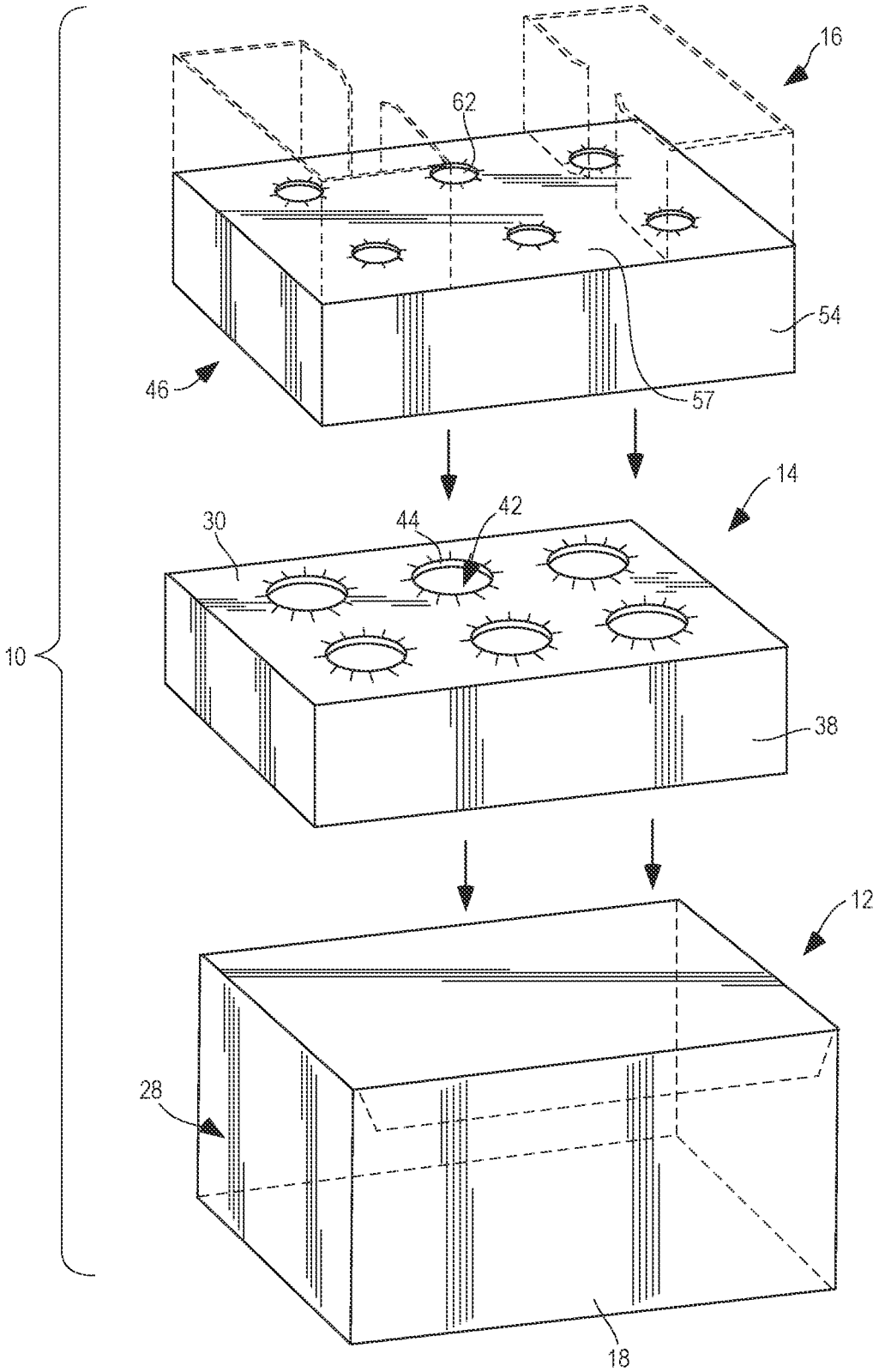
FIG. 1 is an exploded simplified perspective view of a packaging container in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. It will be appreciated that some or all of the various features and structures described and shown with respect to each of the specific embodiments referenced herein may be combined to form additional or alternative embodiments having such combinations and that such combinations are within the scope of the present invention.

Referring to the several figures, the present invention is directed generally toward a shipping or packaging container 10 configured for holding one or more individual bottles, food or beverage receptacles, or similar articles. According to one embodiment, packaging container 10 may be configured to hold multiple beverage bottles (such as wine or other beverage bottles) for shipping, storage, and/or transport. In particular, packaging container 10 may be configured to hold multiple fragile articles (such as glass bottles) in a spaced apart and stable condition to prevent or limit damage during shipping and transport. Packaging container 10 may also be sized and configured to hold any desired number of articles. The several figures illustrate packaging container 10 configured to hold up to six articles; however, packaging container 10 can be configured to hold any number of articles and any desirable arrangement by changing the dimensions of packaging container 10 and/or the layout of the interior of packaging container 10, as described in greater detail below. For example, in certain embodiments (not shown), packaging container 10 may be configured to hold 2 articles, 4 articles, 8 articles, 12 articles, or any other desired number by increasing or decreasing the dimensions of the components of packaging container and the number of openings for receiving the articles as described herein.

Figure 2:
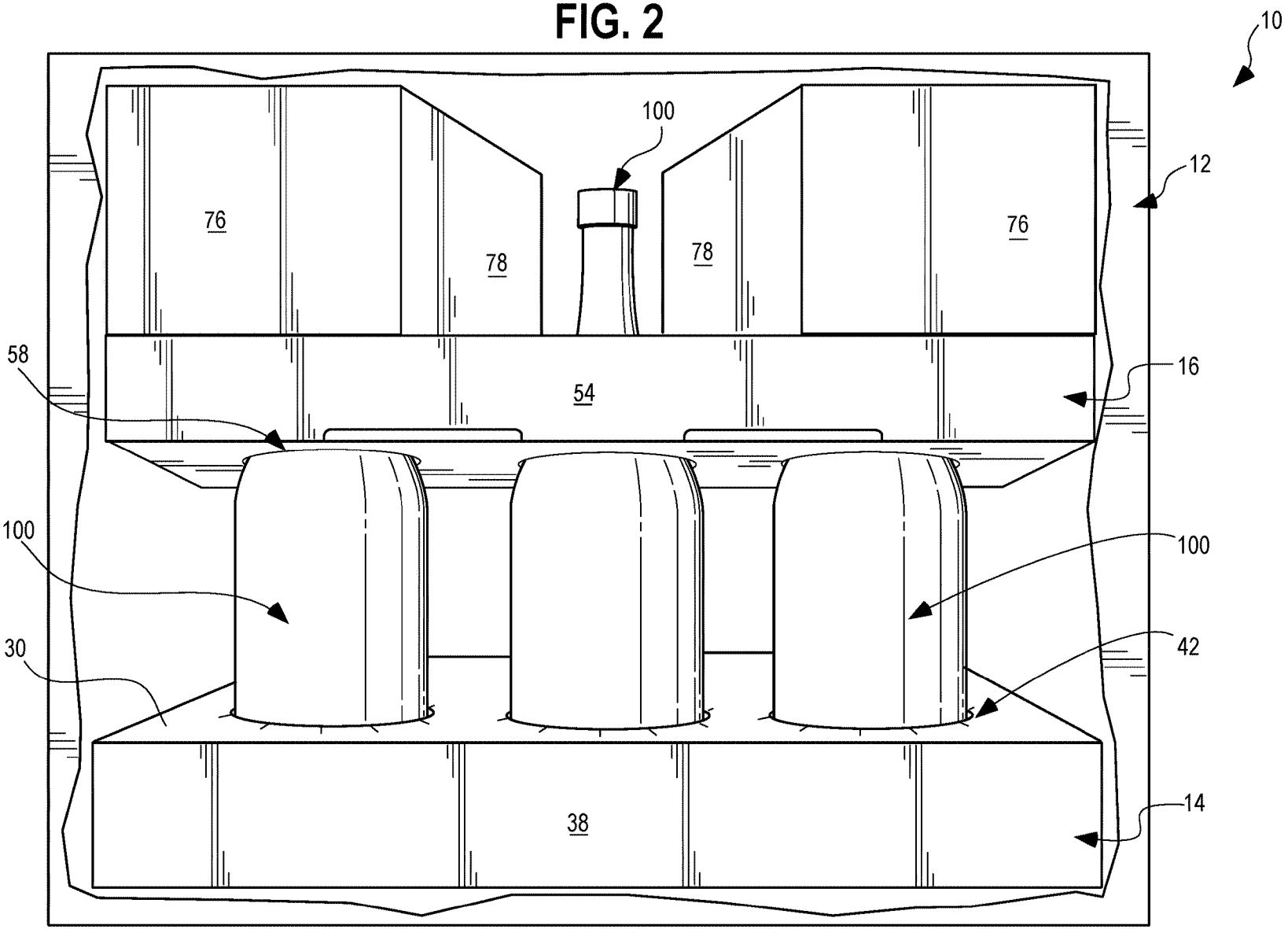
FIG. 2 is a perspective cutaway view of the packaging container of FIG. 1 illustrating an assembled configuration of the packaging container in accordance with one embodiment of the present invention.

As best shown in FIGS. 1 and 2, packaging container 10 may include an outer carton 12, a first insert tray 14, and a second insert tray 16. As described in greater detail herein, first and second insert trays 14 and 16 may be configured to be inserted into outer carton 12 and receive one or more articles 100 in order to isolate and maintain a plurality of articles 100 (such as beverage bottles) in a stable and separated arrangement for shipping, storage and/or transport.

The configuration of packaging container 10 can further allow for a minimal use of material for a packaging system designed to hold individual items by stabilizing the individual items within packaging container 10. The entirety of packaging container 10 (including outer carton 12, first insert tray 14, and second insert tray 16) may all be comprised of a single material, such as paperboard, cardboard, or corrugated cardboard in order to maintain efficiency of material usage. Packaging container 10 may further be constructed from a single material such as a paper-based of fiber-based material that is recyclable, biodegradable, and/or compostable.

According to one embodiment, each of outer carton 12, first insert tray 14, and second insert tray 16 may each be constructed from a single unitary blank of material, which may be produced from material sheets (see FIGS. 3-5) to maximize the efficiency of material usage. Further, each of outer carton 12, first insert tray 14, and second insert tray 16 may be separately manufactured and configured, packaging container 10 may provide for faster and more efficient packaging of articles 100 to be contained within packaging container 10 during a production line.

Figure 3:
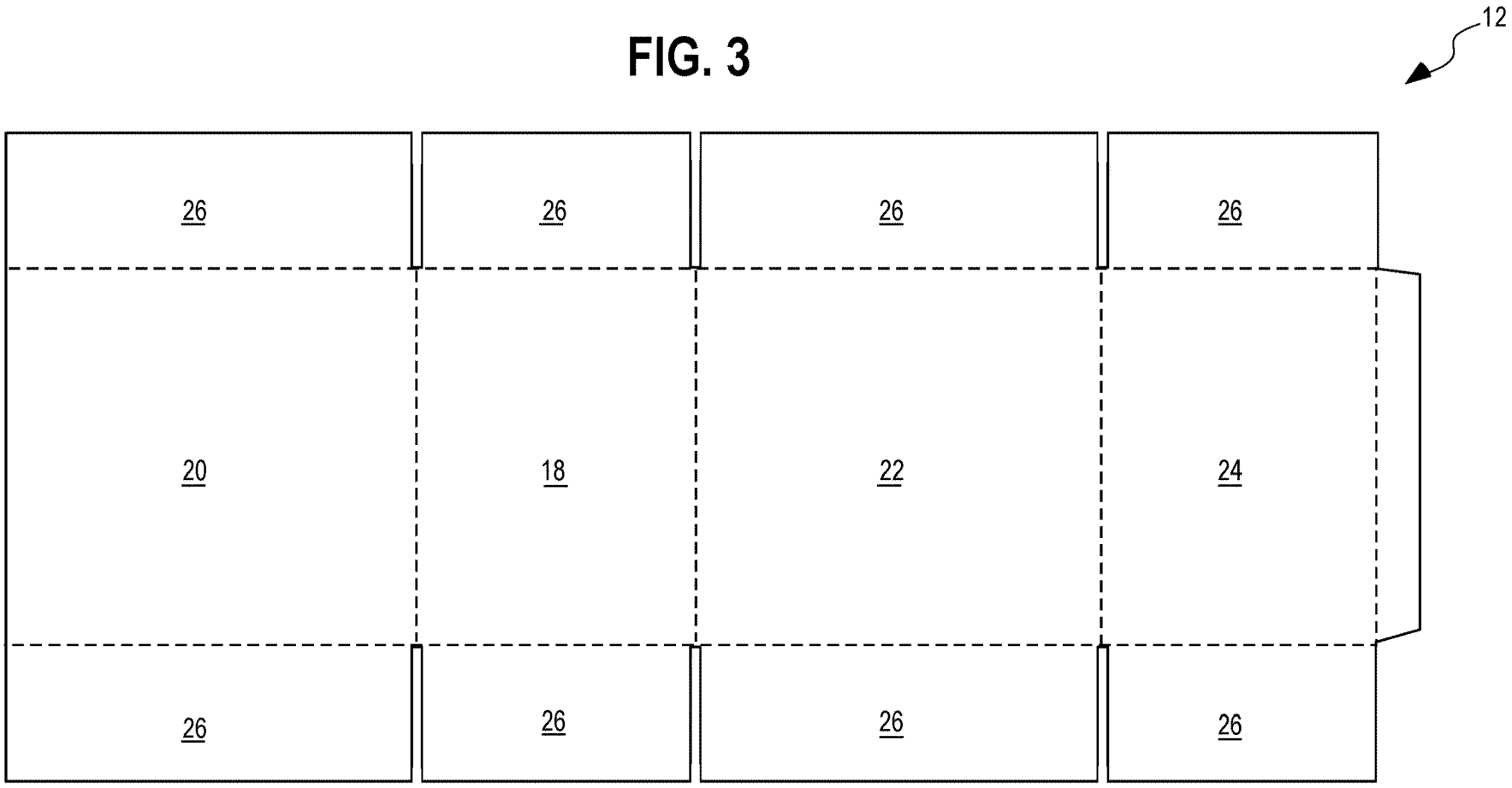
FIG. 3 is a plan view of a blank for an outer carton of the packaging container of FIG. 1.

As best shown in FIGS. 1 and 3, outer carton 12 may be configured as a traditional rectangular cross-section carton or container, constructed from paperboard, cardboard, corrugated cardboard, or other suitable material. Outer carton 12 may include a bottom panel 18, front and rear wall panels 20 and 22 foldably connected along the longitudinal edges of bottom panel 18, respectively, and a top panel 24 foldably connected to the opposing longitudinal edge of rear panel 22. As shown in FIG. 3, one or more of panels 18, 20, 22, and 24 may include end panels or end flaps 26 foldably connected to their lateral edges. When forming outer carton 12 from a material blank (such as shown in FIG. 3), front and rear panels 20 and 22 may be folded upward relative to bottom panel 18 and the corresponding end flaps 26 connected to each of panels 18, 20, and 22 may be folded along their corresponding lateral edges in an overlapping fashion to form the sidewalls 28 of outer carton 12. End flaps 26 may be secured together using glue, adhesive, or other suitable means. According to certain embodiments, flaps 26 may be secured together without the use of adhesive by using interlocking tabs and slots or other suitable means formed into the panels and flaps of outer carton 12. Top panel 24 may further include a locking tab foldably connected thereto, which may be secured to front panel 20 in order to enclose the interior of outer carton 12. It will be appreciated that various configurations of outer carton 12 may be employed, including without limitation, those commonly known and used for paperboard, cardboard and corrugated cardboard cartons, boxes, and the like.

As best shown in FIGS. 4 and 6-8, first insert tray 14 may include a base panel 30 and longitudinal side panels 32 extending from and foldably connected to the longitudinal edges of base panel 30. First insert tray 14 may further include end panels 34 extending from and foldably connected to the lateral edges of base panel 30. Base panel 30 may be configured with a size and shape generally conforming to bottom panel 18 of outer carton 12 to enable first insert tray 14 to be inserted into outer carton 12. According to one embodiment, base panel 30 may have a length and width approximately equal to or slightly less than the length and width of bottom panel 18 and the interior volume of outer carton 12 so that when first insert tray 14 is inserted into outer carton 12 (as described in greater detail herein), first insert tray 14 is generally restricted from horizontal movement within the interior of outer carton 12.

Figure 4:
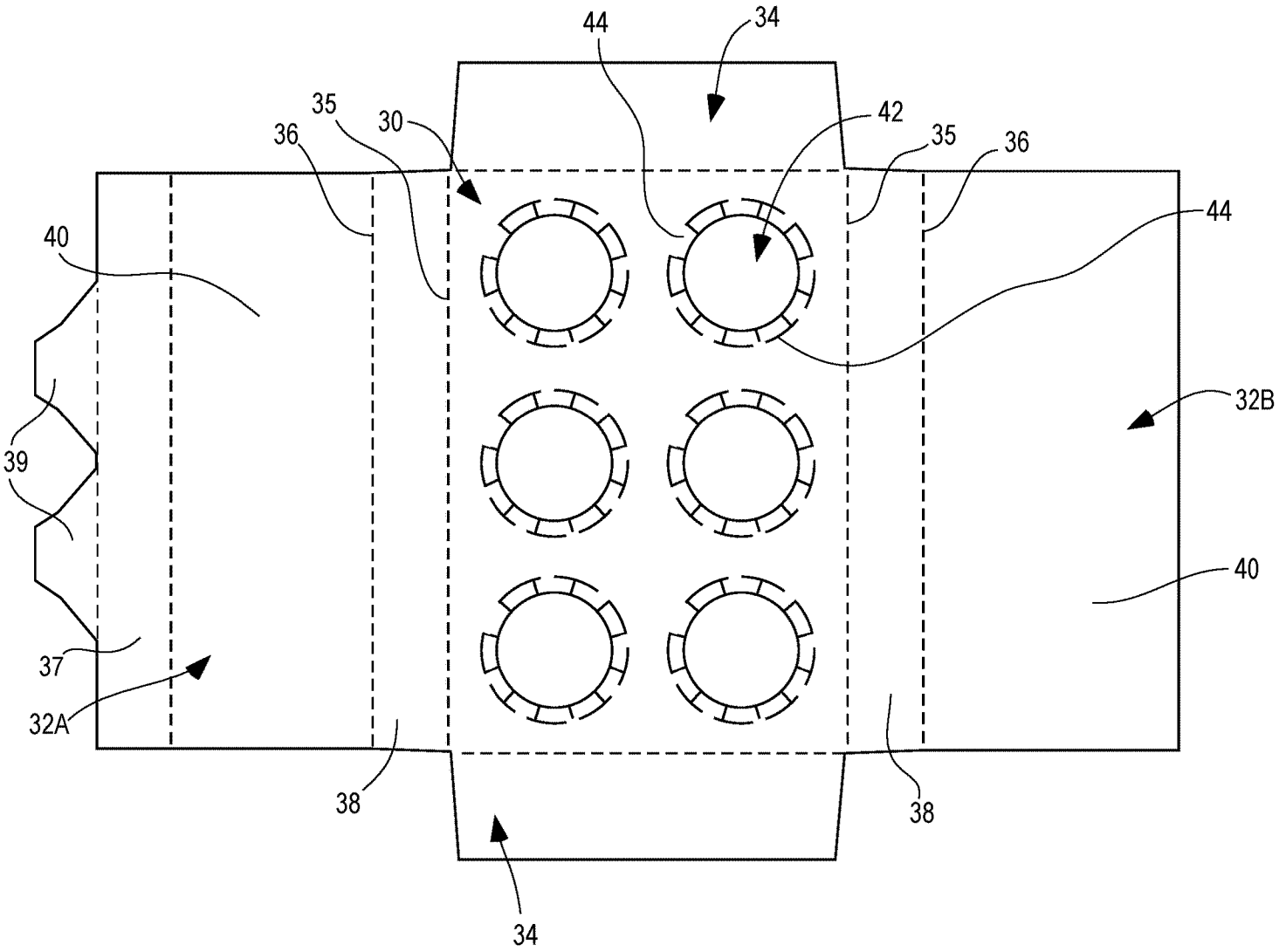
FIG. 4 is a plan view of a blank for a first insert tray of the packaging container of FIG. 1.

As best illustrated in FIG. 4, longitudinal side panels 32 may each include a first fold line 35 and an intermediate or second fold line 36 formed therein to provide a sidewall section 38 and an underlapped or bottom wall section 40 when first insert tray 14 is formed. Sidewall sections 38 may form the sidewalls of first insert tray 14 when each is folded along first fold line 35 in a generally perpendicular arrangement relative to base panel 30. Bottom wall sections 40 of longitudinal side panels 32 may collectively form a bottom wall of first insert tray 14 by folding each along second fold line 36 in a generally perpendicular arrangement relative to sidewall sections 38 (and generally parallel arrangement to base panel 30).

As further shown in FIG. 4, according to one embodiment, first insert tray 14 may be configured with a first longitudinal side panel 32A and a second longitudinal side panel 32B. First longitudinal side panel 32A may additionally include an extension panel 37 extending from the outer longitudinal edge of bottom wall section 40 along a fold line. Extension panel 37 may further have one or more end tabs 39 extending from the outer longitudinal edge of extension panel 37 and foldably connected thereto along a fold line. Extension panel 37 and tabs 39 may assist in forming first insert tray 14 and securing tray 14 in a folded and configured position as described below.

Figure 7:
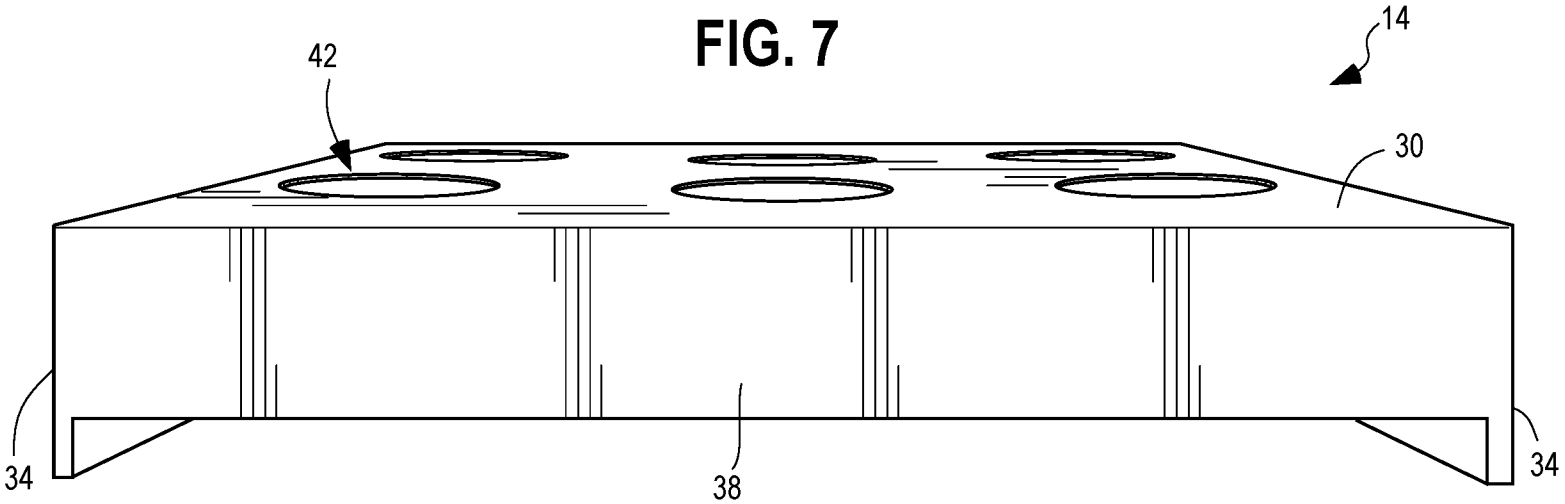
FIG. 7 is a side perspective view of the first insert tray of FIG. 6.

First insert tray 14 may be formed from a material blank (see FIG. 4) by folding longitudinal side panels 32 and end panels 34 downward relative to base panel 30. Folded sidewall sections 38 may be folded (at fold line 35) relative to base panel 30 and then bottom wall sections 40 may be folded (at fold line 36) relative to sidewall sections 38 so that both bottom wall sections 40 are in a generally overlapping arrangement with respect to one another and a generally parallel arrangement relative to base panel 30. End panels 34 may then be folded downwardly in a generally perpendicular orientation relative to base panel 30 and overlapping bottom wall 40 as shown in FIG. 7. As further shown in FIG. 7, end panels 34 may have a height larger than the height of side wall sections 38 so that the bottom edges of end panels 34 extend below the overlapped bottom wall 40. This configuration can allow for a gap or air space to be provided between overlapped bottom wall 40 of first insert tray 14 and bottom panel 18 of outer carton 12 when first insert tray 14 is inserted into outer carton 12 (as described in greater detail below). As a result, when articles 100 are received within packaging container 10, as also described below, the articles 100 remain separated and spaced apart from bottom wall 18 of outer carton 12 to reduce potential damage to the articles 100 during transport and storage while within packaging container 10.

To form first insert tray 14 according to one embodiment, first longitudinal panel 32A may first be folded to form sidewall section 38 and place panel 40 in a generally parallel and underlying arrangement relative to base panel 30. Extension panel 37 may then be folded downward and tabs 39 may be secured to base panel 30 by an adhesive to secure panel 37 in place. Then second longitudinal side panel 32B may be folded similarly in a partially overlapped arrangement with panel 32A and then secured thereto by an adhesive or the like. End panels 34 may then be folded downward relative to base panel 30 so that the bottom edges of end panels 34 extend below bottom wall 40. End panels 34 may be optionally secured to sidewall sections 38 or bottom wall 40 using adhesive, tape, locking tabs or any other suitable means to maintain end panels 40 in a generally perpendicular orientation relative to base panel 30.

Figure 6:
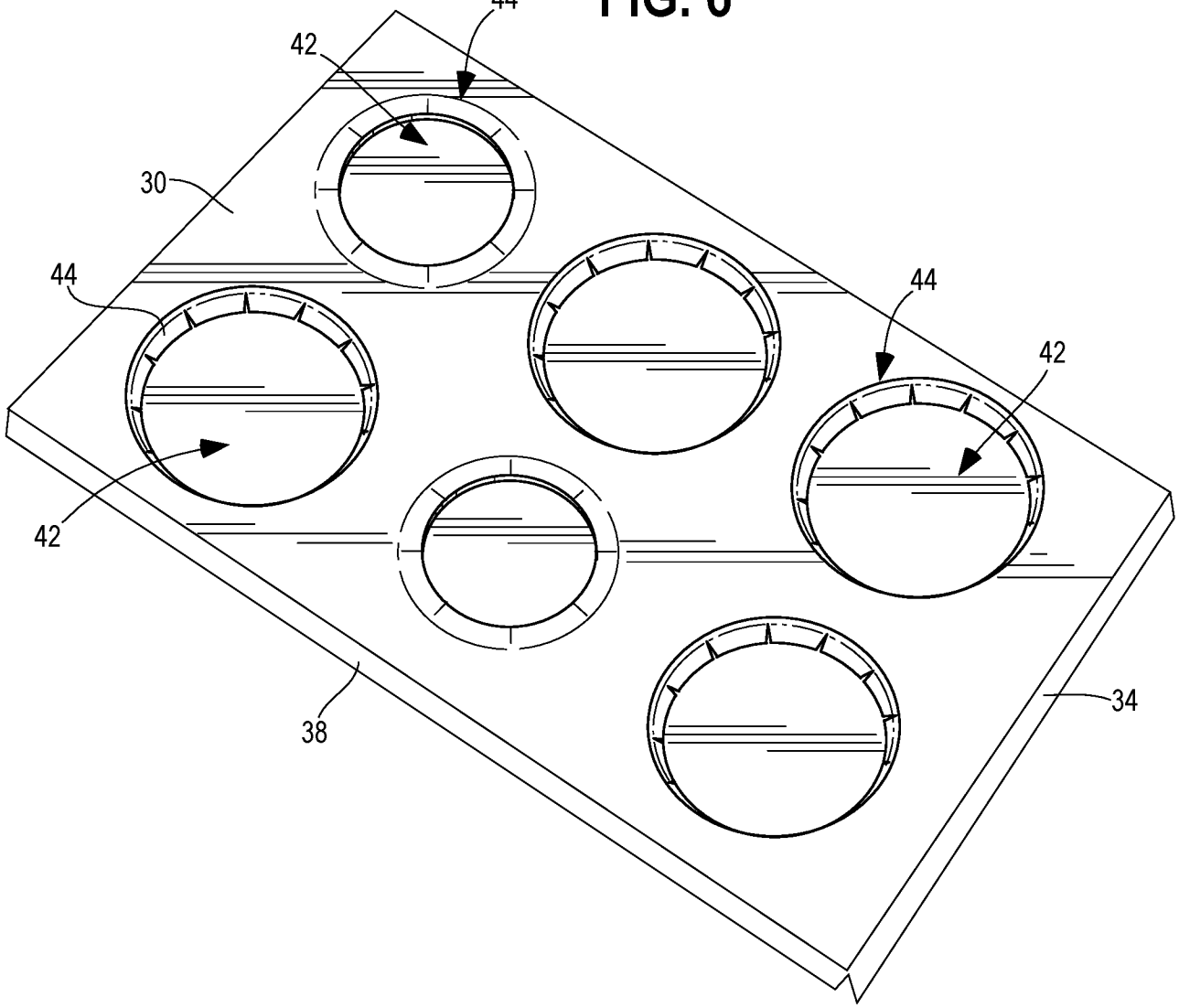
FIG. 6 is a top perspective view of a first insert tray of the packaging container of FIG. 1 in accordance with one embodiment of the present invention.

As further shown in FIGS. 1, 4 and 6, base panel 30 may include a plurality of spaced openings 42 defined through base panel 30. Openings 42 may have a circular shape that generally corresponds to the diameter and shape of traditional glass or plastic bottles; however, it is recognized that openings 42 may be suitably adapted with any desired shape to correspond to an article that it is intended to receive. Openings 42 may further include a plurality of deformable tabs 44 defined around the perimeter of opening 42 (by means of a plurality of cuts or slits or other suitable means) to provide for a frictional interference fit with an article (such as a bottle) inserted into the opening 42. Tabs 44 may also enable opening 42 to accommodate articles 100 of different shapes and sizes. FIG. 6 best illustrates openings 42 and associated tabs 44 in both a deformed and non-deformed states. As shown, four of the openings 42 have tabs 44 that have been deformed as a result of an article (not shown) being inserted therein. Tabs 44 deflect downward to accommodate the diameter and size of the article and engage the sidewall of the article. As further shown, the remaining two openings 42 have tabs 44 that have not been deformed where the tabs 44 remain generally horizontal and along the same plane as base panel 30.

As best shown in FIG. 2, when an article or bottle is inserted into opening 42, the height of first insert tray 14 created by sidewall 38 can allow the article or bottle to be partially received within first insert tray 14. As a result, first insert tray 14 may engage the article or bottle at an intermediate position along the height of the article or bottle to provide additional stability within packaging container 10. As shown in FIG. 4, according to one embodiment first insert tray 14 can include six openings in base panel 30 to allow first insert tray 14 (and packaging container 10 overall) to hold up to six bottles or other articles. However, it is recognized that first insert tray 14 can be configured with any desired number of openings 42 to allow packaging container 14 to hold and store any number of bottles or other articles in alternative embodiments of the packaging container 10. Similarly, it is also recognized that openings 42 defined into base panel 30 of first insert tray 14 can be arranged in any suitable desired positioning and spacing within base panel 30.

As best shown in FIGS. 5 and 9-11, second insert tray 16 may include a lower base panel 46 and longitudinal side panels 48 (shown as 48A and 48B) extending from and foldably connected to the longitudinal edges of lower base panel 46. Second insert tray 16 may further include end panels 50 extending from and foldably connected to the lateral edges of lower base panel 46. Lower base panel 46 may be configured with a size and shape generally conforming to bottom panel 18 of outer carton 12 to enable second insert tray 16 to be inserted into outer carton 12. According to one embodiment, lower base panel 46 may have a length and width approximately equal to or slightly less than the length and width of bottom panel 18 and the interior volume of outer carton 12 so that when second insert tray 16 is inserted into outer carton 12 (as described in greater detail herein), second insert tray 16 is generally restricted from horizontal movement within the interior of outer carton 12. Lower base panel 46 of second insert tray 16 may also be configured with a size approximately equal and conforming base panel 30 of first insert tray 14 so that both may be inserted and received within outer carton 12.

Figure 5:
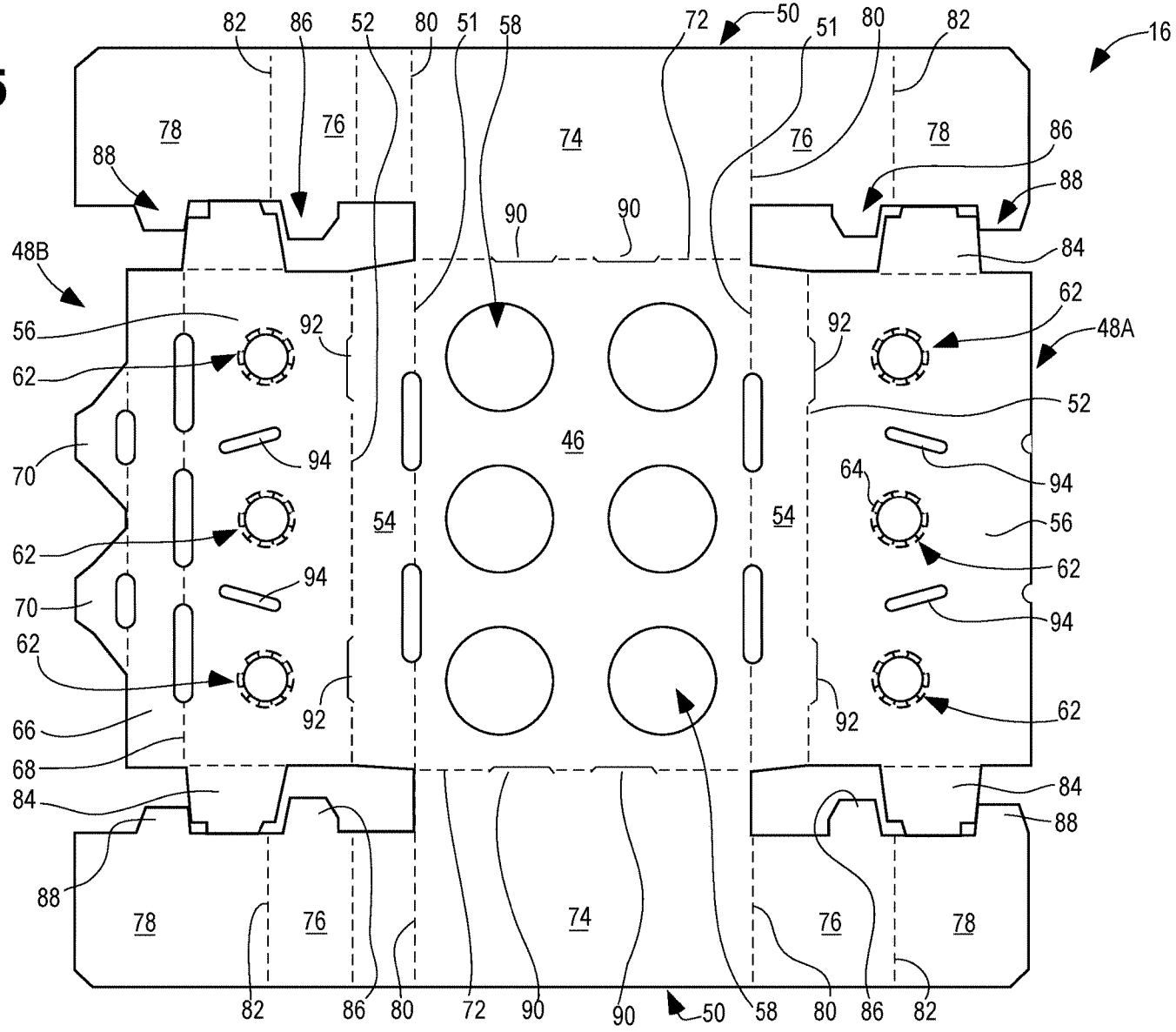
FIG. 5 is a plan view of a blank for a second insert tray of the packaging container of FIG. 1.
Figure 9:
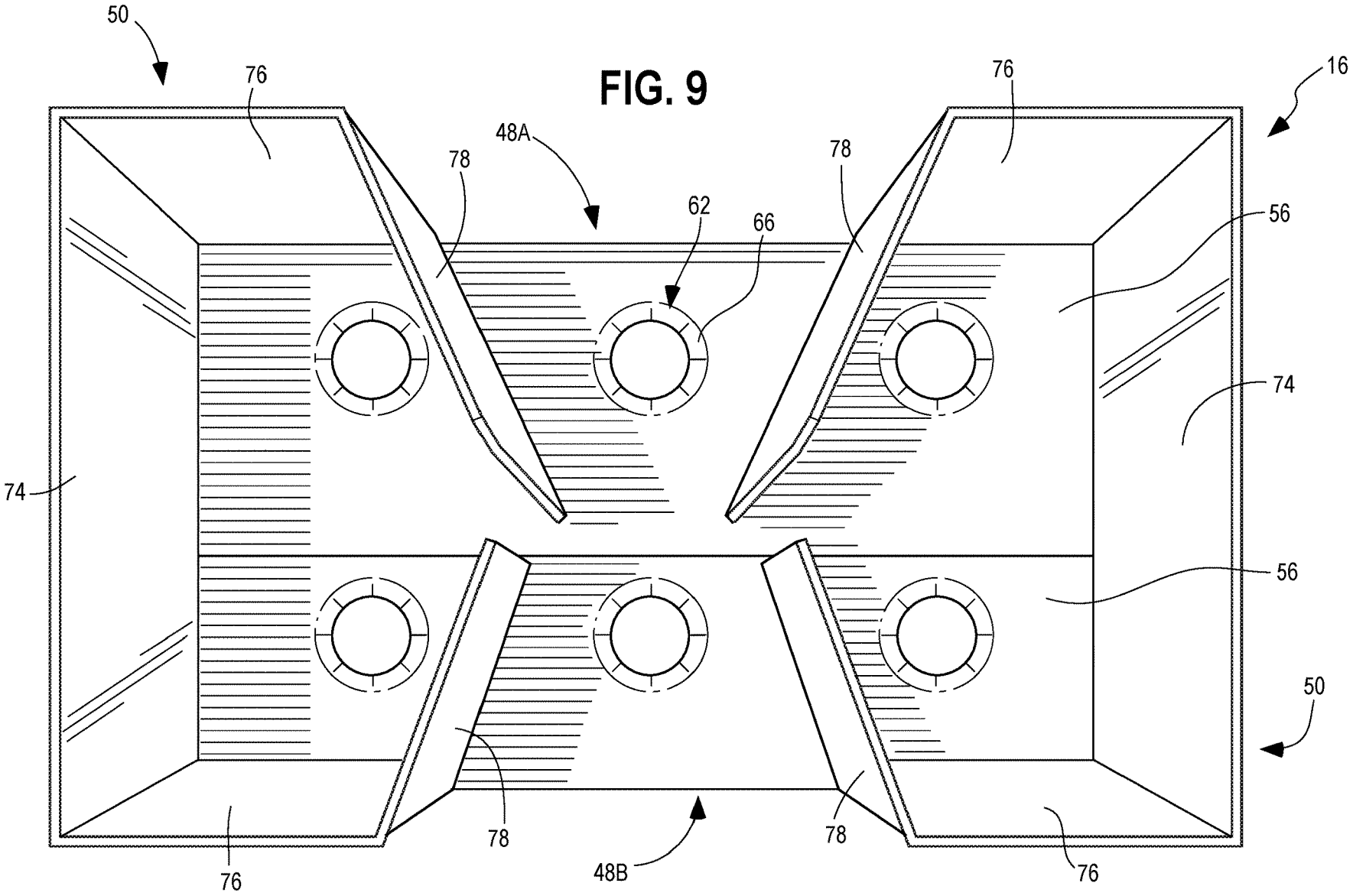
FIG. 9 is a top perspective view of a second insert tray of the packaging container of FIG. 1 in accordance with one embodiment of the present invention.
Figure 11:
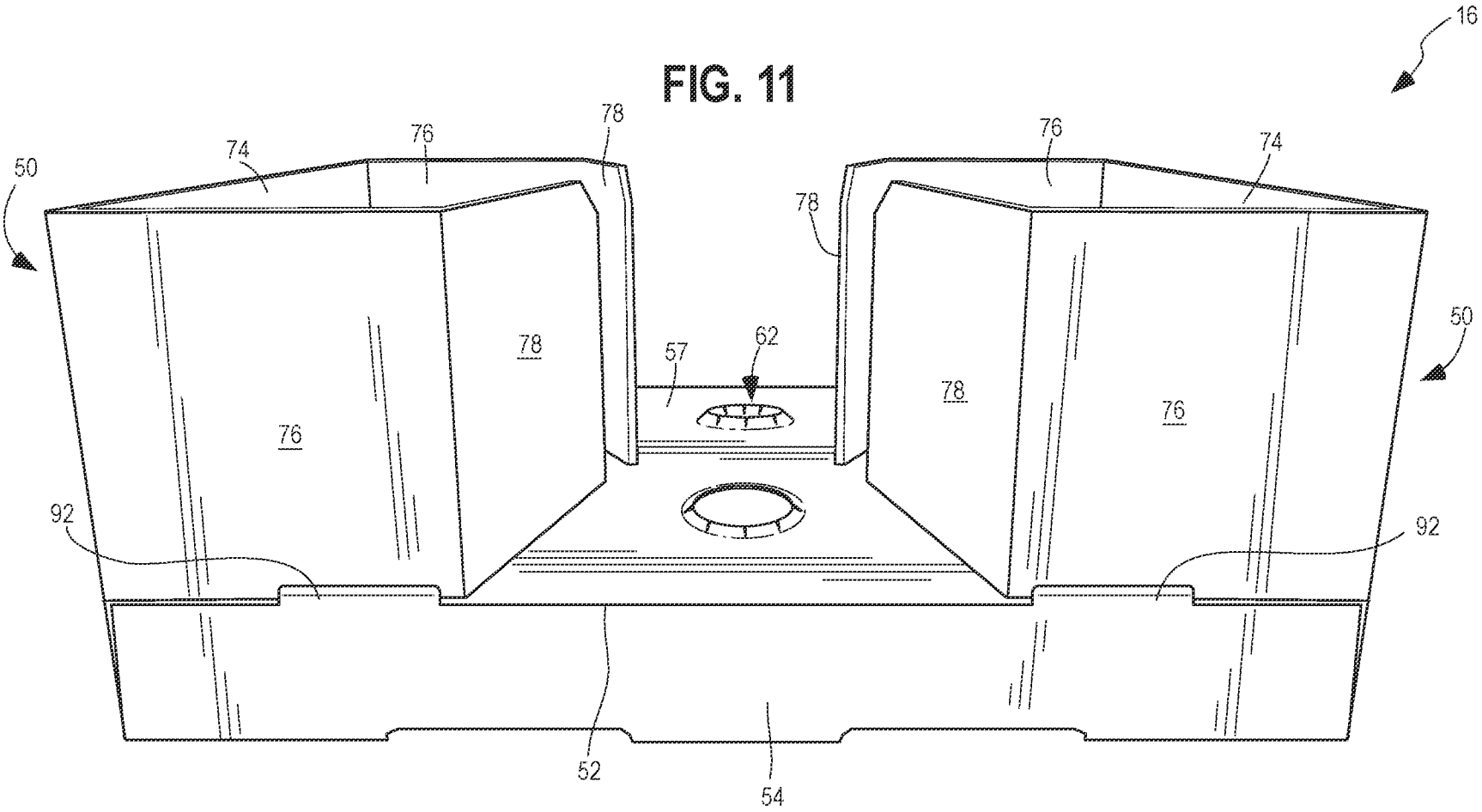
FIG. 11 is a side perspective view of the second insert tray of FIG. 9.
Figure 12:
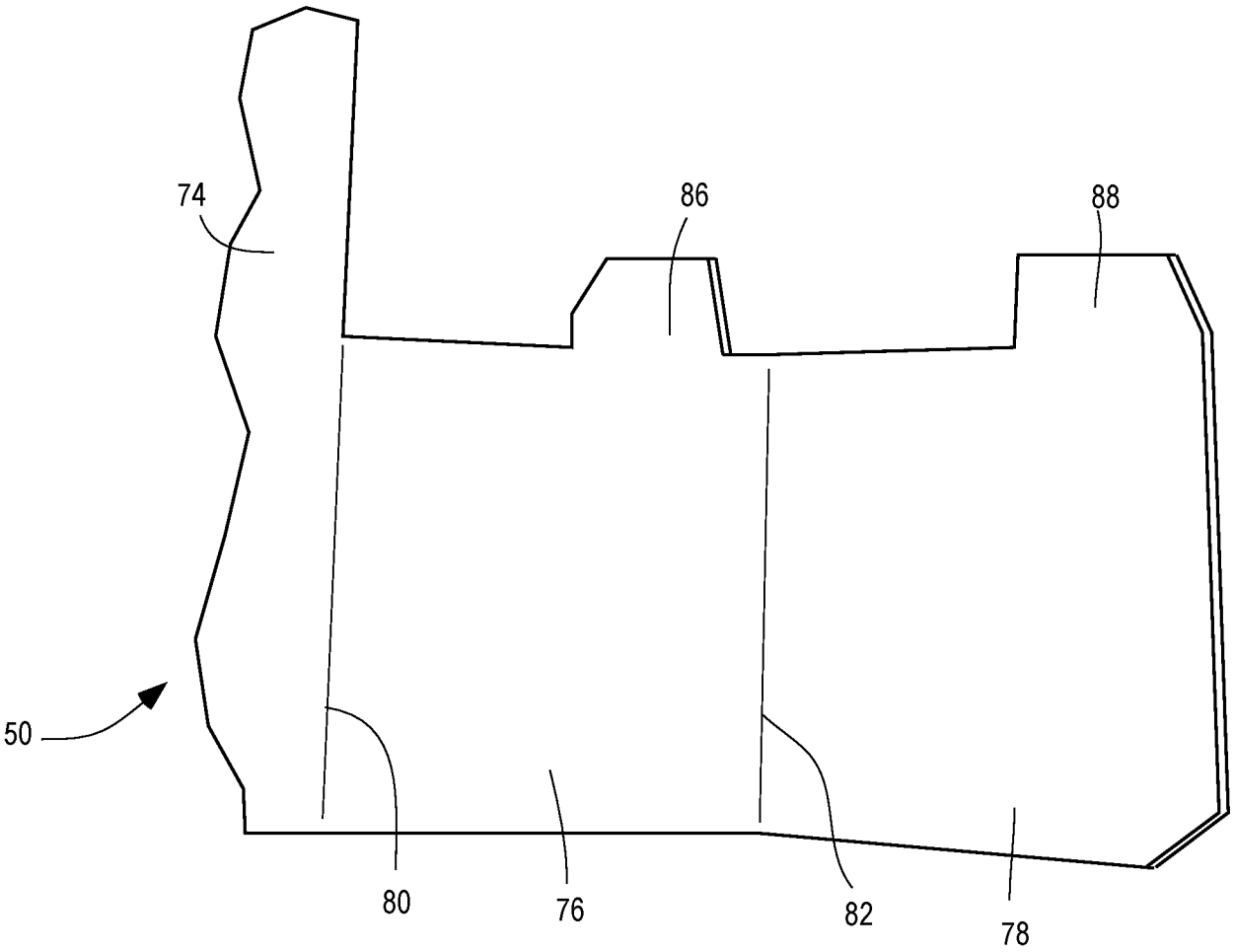
FIG. 12 is a partial top perspective view of the second insert tray of FIG. 9 illustrating connecting tabs in accordance with one embodiment of the present invention.
Figure 13:
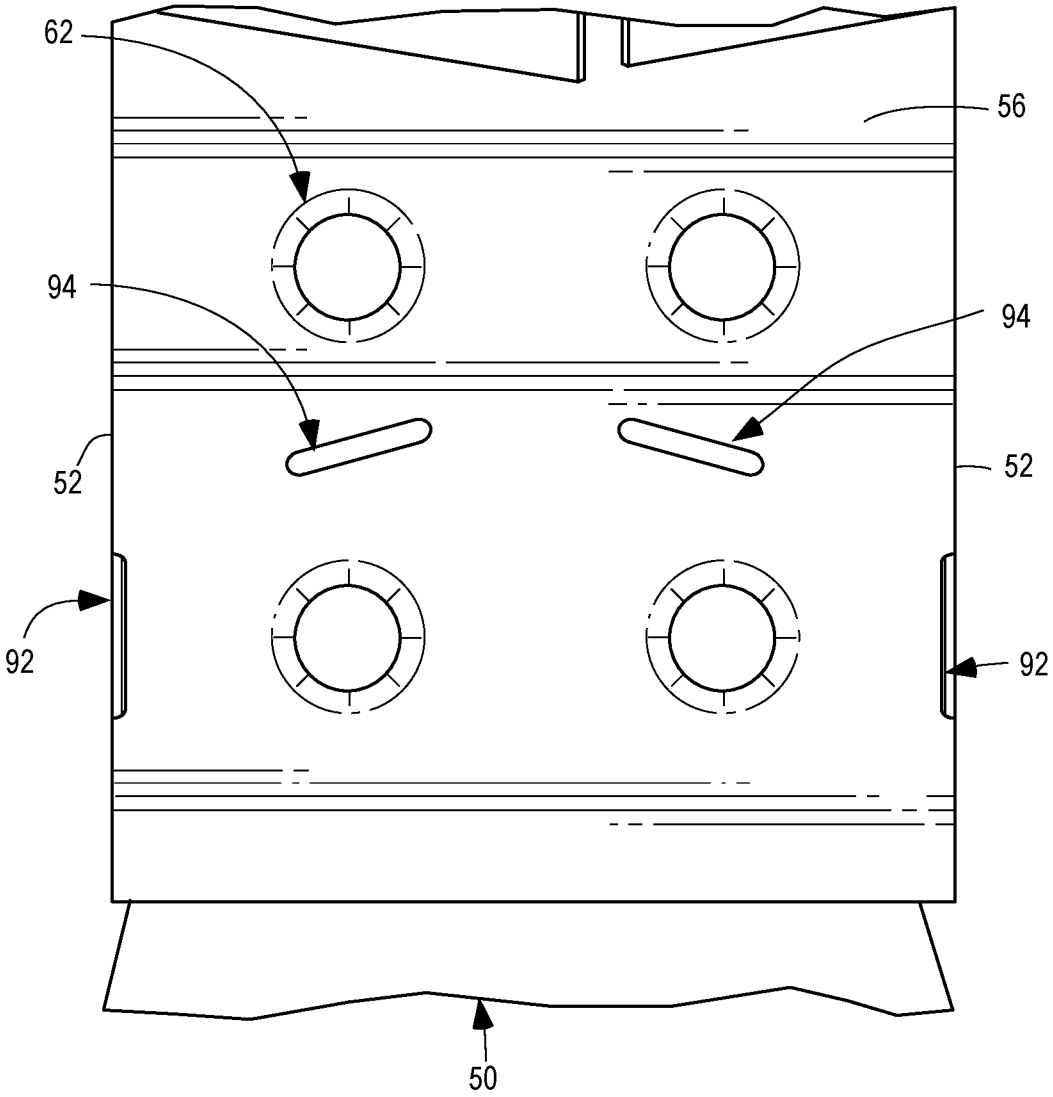
FIG. 13 is a partial top perspective view of the second insert tray of FIG. 9 illustrating tab slots in accordance with one embodiment of the present invention.

As best shown in FIG. 5, each longitudinal side panel 48 is foldably connected to the longitudinal edge of lower base panel 46 by a fold line 51. As further shown, each longitudinal side panel 48 may also include an intermediate fold line 52 defined longitudinally across panel 48 to form a sidewall section 54 and a top wall section 56 when second insert tray 16 is formed. Each second sidewall section 54 extends from fold line 51 to fold line 54 and may form a sidewall of second insert tray 16 when each is folded along first fold line 51 in a generally perpendicular arrangement relative to lower base panel 46. Top wall sections 56 of longitudinal side panels 48 may collectively form a top wall 57 of second insert tray 16 by folding each along fold line 52 in a generally perpendicular arrangement relative to sidewall sections 54 and an overlapping arrangement spaced apart from and generally parallel to lower base panel 46 as best illustrated in FIGS. 1, 9 and 11.

Figure 10:
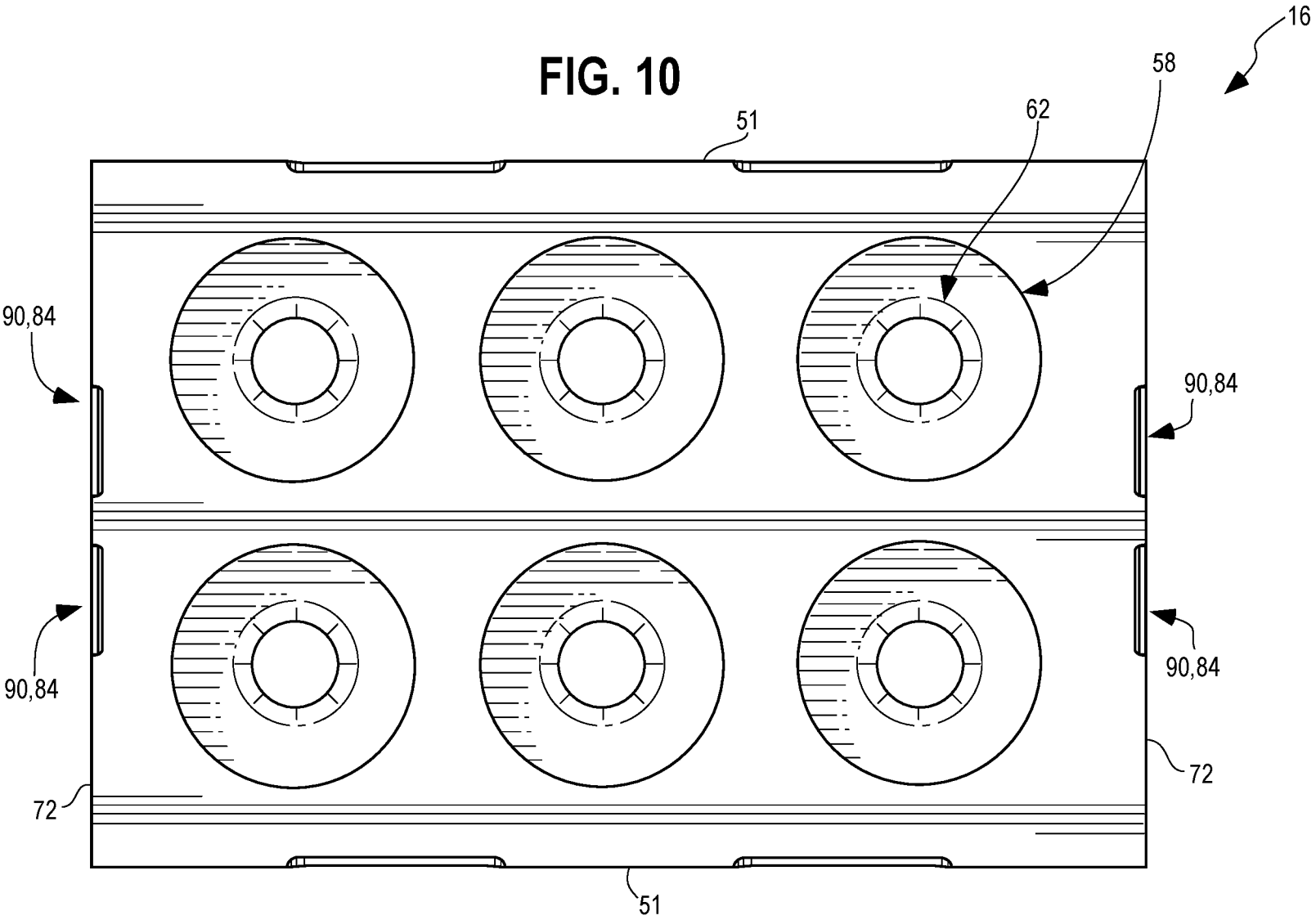
FIG. 10 is a bottom perspective view of the second insert tray of FIG. 9.

As further shown in FIGS. 5 and 10, lower base panel 46 may include a plurality of spaced main or primary openings 58 defined through lower base panel 46. Primary openings 58 may have a circular shape that generally corresponds to the diameter and shape of traditional glass or plastic bottles; however, it is recognized that primary openings 58 may be suitably adapted with any desired shape. According to certain embodiments, primary openings 58 may have a diameter approximately equal to or less than openings 42 of first tray insert 14. Such a configuration may allow primary openings 58 of second tray insert 16 to receive the upper, narrowed "neck" region of a bottle or similar article and an intermediate or lower (base) portion of a bottle or similar article 100 (see FIGS. 2 and 14). Further, the configured diameter of primary openings 58 be approximately equal to or less than openings 42 of first tray insert 14 to receive the narrowed upper region of an article 100 while also restraining the intermediate or lower base region of the article 11. As also shown in FIG. 5, primary openings 58 may include a plurality of deformable tabs (not shown) defined around the perimeter of each main opening 58 to provide for a frictional interference fit, similar to openings 42 and tabs 44 of first tray insert 14 described previously.

As further shown in FIGS. 5 and 9-11, second tray insert 16 may include a plurality of secondary openings 62 defined through both top wall sections 56 of side panels 48. Secondary openings 62 may be positioned intermediately within top wall sections 56 so that they are generally aligned with and overlay primary openings 58 (defined in lower base panel 46) when second tray insert 16 is formed. As a result, each secondary opening 62 may be aligned with a corresponding main opening 58 both laterally and longitudinally so that a generally vertical axis passes through both respective openings 62 and 58 (i.e., openings 58 and 62 axially aligned along a vertical axis). As described in further detail below, openings 58 and 62 may also be axially aligned with openings 42 of first insert tray 14 when both trays 14 and 16 are inserted into outer carton 12.

Secondary openings 62 may be configured to receive the upper, narrowed "neck" region of a bottle or similar article 100 when packaging container 10 is in use (see FIG. 2). As shown in FIG. 5, secondary openings 62 may have a size and diameter less than primary openings 58 in order to effectively secure and restrain the narrowed "neck" region of a bottle or similar article, which is less than the larger, base portion of the bottle or similar article received by primary openings 58 of second insert tray 16 and openings 42 of first insert tray 14. As further shown in FIG. 5, secondary openings 62 may include a plurality of deformable tabs 64 formed around the perimeter of secondary openings 62 in order to provide a greater frictional interference fit when an article is inserted through secondary openings 62 and allow for secondary openings 62 to receive bottles or articles of differing sizes and shapes.

As further shown in FIG. 5, according to one embodiment of the present invention, second insert tray 16 may include two different longitudinal side panels 48A and 48B. Panel 48A may include both sidewall section 54 and top wall section 56 connected along intermediate fold line 52, with top wall section 56 having a terminal edge also defining the outer terminal edge of panel 48A. Panel 48A may similarly include both sidewall section 54 and top wall section 56 connected along intermediate fold line 52. Panel 48B may also include an end flap 66 foldably connected to top wall section 56 along a second intermediate fold line 68 (located on the opposite side of top wall section 56 with intermediate fold line 52). End flap 66 may be configured with a width approximately equal to or similar to the width of sidewall section 54. Panel 48B may also include one or more end tabs 70 foldably connected along the terminal end of end flap 66. End flap 66 and end tabs 70 may be used to facilitate formation of second insert tray 16 (as described in greater detail below) and provide additional structural rigidity to second insert tray 16 when in use. It is also recognized that in alternative embodiments of second insert tray 16, both longitudinal side panels 48A and 48B may be identically form as panel 48A described above.

As further shown in FIG. 5, end panels 50 may be foldably connected to the lateral edges of lower base panel 46 along a fold line 72 that is generally aligned with the lateral terminal edges of longitudinal side panels 48. Each end panel 50 may include a main panel section 74, a first side panel section 76 and a second side panel section 78. First side panel section 76 may extend from and be connected to a longitudinal edge of main panel section 74 along a fold line 80. Second side panel section 78 may extend from and be connected to the longitudinal edge of first side panel section 76 by a second fold line 82 (opposite fold line 80). Both first and second side panel sections 76 and 78 may have a width less than the width of main panel 74 so that a gap is provided between first and second side panels 76 and 78 and the lateral terminal edge of panels 48. The width of the gap may be approximately equal to the width of side wall sections 54 so that the lower edge of first and second side panel sections 76 and 78 are generally aligned and at the same height as top wall panels 56 of panels 48.

As further shown in FIGS. 5 and 10-13, second insert tray 16 may include several corresponding locking tabs 84-88 and receiving slots 90-94 that assist in forming and securing second insert tray 16 in a formed configuration. As shown in FIG. 5, top wall section 56 of each longitudinal side panel 48A and 48B may include a pair of locking tabs 84 extending outward from the lateral side edges of top wall section 56. As further shown in FIG. 5, lower base panel 46 may include two receiving slots 90 positioned along each fold line 72 connecting end panels 50 to lower base panel 46. Receiving slots 90 may be configured as slits or cuts extending through fold line 72 and may include angled side cuts at each end in order to receive locking tabs 84 when second insert tray 16 is formed.

As shown in FIG. 5, each end panel 50 may include first locking tabs 86 and second locking tabs 88. As shown, each first side panel section 76 of each end panel 50 may include a first locking tab 86 extending away from its lateral edge. Similarly, each second side panel section 78 may include a second locking tab 88 extending away from its lateral edge. First locking tabs 86 are configured to be received by receiving slots 92 defined into fold line 52 connecting sidewall section 54 and top wall section 56 of longitudinal side panels 48, and which forms the outer edge of top wall section 56 when second insert tray 16 is formed. Second locking tabs 88 are configured to be received by receiving slots 94 located within the interior of top wall section 56. FIGS. 9-13 illustrate the interlocking of tabs 84-88 and slots 90-94.

Second insert tray 16 may be formed from a material blank (see FIG. 5) and folded into a formed configuration as best illustrated in FIGS. 9 and 11. Longitudinal side panels 48 may be folded upward at fold line 51 for form sidewall panels 54 in a generally perpendicular orientation relative to lower base panel 46. Top wall sections 56 may then be folded along fold line 52 to partially overlap the two top wall sections 56 to provide a top wall 57 of second insert tray 16 that is orientated generally parallel to lower base panel 46. As best shown in FIGS. 2 and 11, sidewall sections 54 also separate top wall 57 from lower base panel 46 so that they are in a spaced-apart arrangement with a gap therebetween.

According to one embodiment, second insert tray 16 may be formed by folding longitudinal side panels 48A and 48B upward along fold line 51 relative to lower base panel 46. The top wall section 56 of each longitudinal side panel 48 may then be folded along intermediate fold line 52 above and over lower base panel 46. Longitudinal side panel 48B may be folded first and end flap 66 may be folded downward perpendicular to top wall section 56 about fold line 68. End tabs 70 may then be secured to lower base panel 46 by an adhesive or the like. Longitudinal side panel 48A may then be folded to partially overlie longitudinal side panel 48B and secured to longitudinal side panel 48B by an adhesive or the like. As longitudinal side panels 48A and 48B are folded into their formed position, locking tabs 84 extending from top wall section 56 may be folded downward and inserted into corresponding receiving slot 90.

Figure 14:
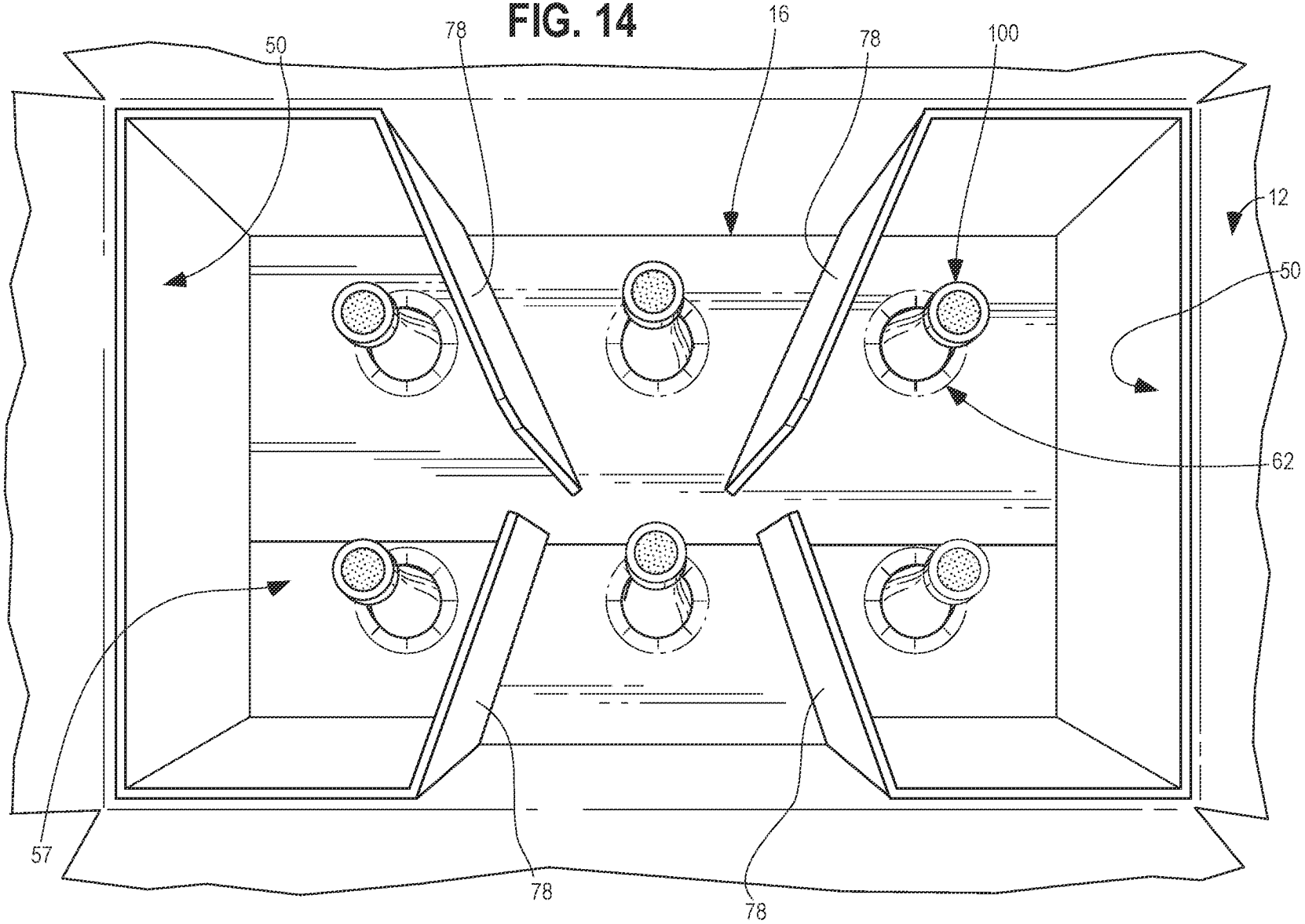
FIG. 14 is a top perspective view of the packaging container of FIG. 1 illustrating an assembled configuration of the packaging container in accordance with one embodiment of the present invention.

After longitudinal side panels 48 are folded into place, end panels 50 may then be folded upward so that main panel section 74 is generally perpendicular to lower base panel 46 (and top wall sections 56). Each first side panel section 76 may then be folded along fold line 80 so that it is aligned with side wall section 54 extending from lower base panel 46 and then locking tab 86 may be inserted into its corresponding slot 92. Finally, each second side panel section 78 of end panels 50 may be folded along fold line 82 and tab 88 may be inserted into receiving slot 94. As best shown in FIGS. 9, 11 and 14, end panels 50 may extend above top wall section 56 and operate to separate and segment openings 62 and the articles contained thereby.

Figure 8:
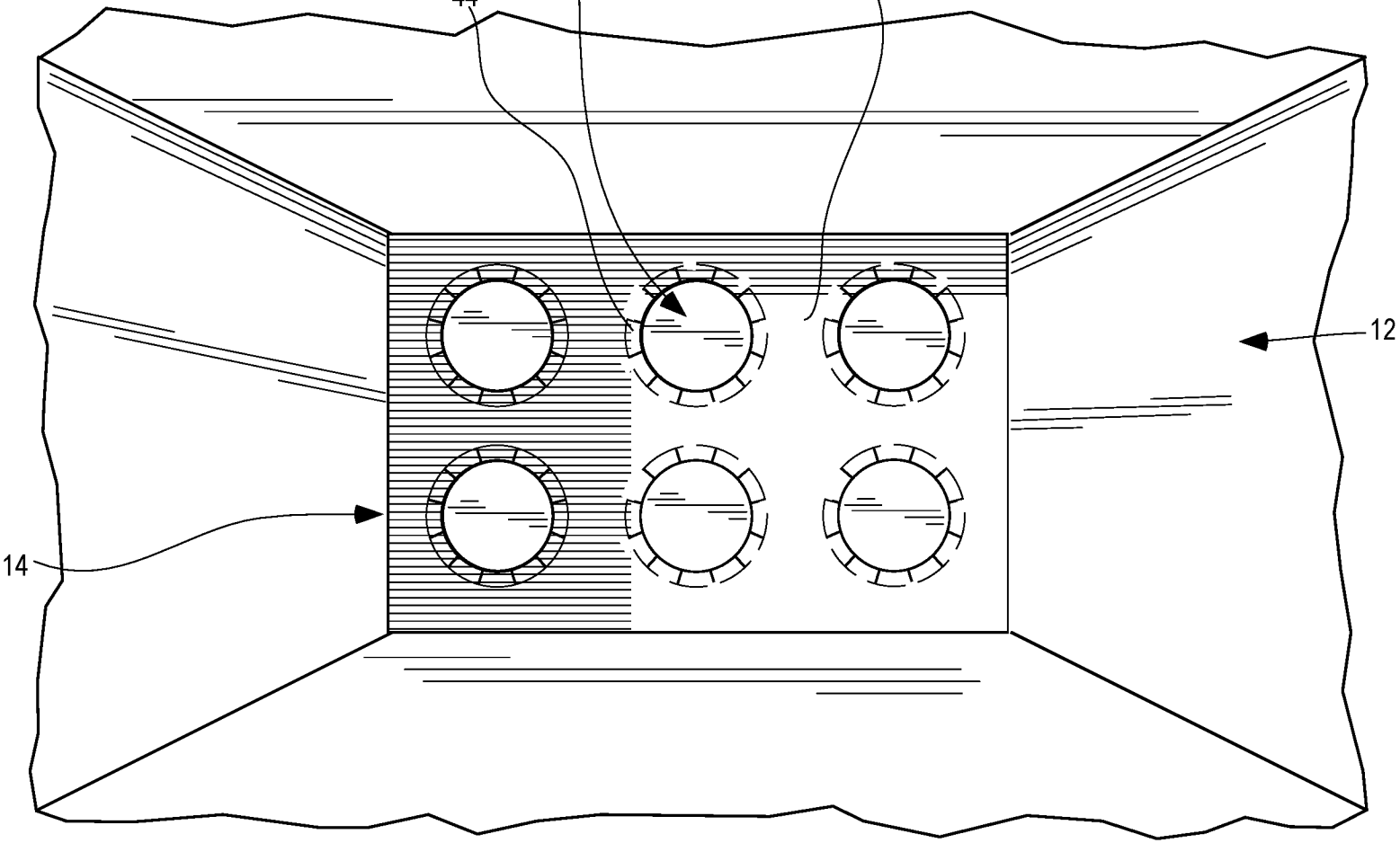
FIG. 8 is a top perspective view of the packaging container of FIG. 1 illustrating a first insert tray inserted into an outer carton in accordance with one embodiment of the present invention.

FIGS. 1, 2, 8 and 14 illustrate the configuration and arrangement of packaging container 10 according to one embodiment of the present invention. Outer carton 12 may be formed and configured by folding panels 20-24 and securing end flaps 26 together to form sidewalls 18. First insert tray 14 may be configured by folding side panels 32 and end panels 34 to form sidewalls 38. Similarly, second insert tray 16 may be configured by folding side panels 48 and end panels 50 to form sidewalls 54, overlapping top wall 57, and folded end panels 50 as described above. Once outer carton 12, first insert tray 14 and second insert tray 16 are formed, packaging container 10 may be packed with one or more articles 100 (such as beverage bottles or similar items). First insert tray 14 may be inserted into the interior of outer carton 12 by inserting first insert tray 14 into outer carton and positioning first insert tray 14 toward the bottom end of outer carton 12 and adjacent to bottom panel 18 as best shown in FIG. 8. As best shown in FIGS. 1 and 2, first insert tray 14 may overlay bottom panel 18 of outer carton 12 and base panel 30 of first insert tray 14 may be slightly spaced above bottom panel 18 as a result of the height of end panels 34 being greater than the height of sidewalls 38 of first insert tray 14. One or more articles 100 may then be inserted into the into openings 42 defined in base panel 30 of first insert tray 14. The articles 100 may be inserted partially through openings 42 and engage the underlapped panel sections 40 of first insert tray 14, which extend over bottom panel 18 of outer carton 12. As described above, the deforming tabs 44 provided on each opening 42 can enable articles 100 of different sizes and shapes to engage the corresponding opening 42 and be appropriately restrained by first insert tray 14.

After the articles 100 have been inserted into first insert tray 14, second insert tray 16 may be inserted into outer carton 12 and onto the articles 100. As best shown in FIGS. 2 and 14, primary openings 58 may receive the upper "neck" portion of the articles 100 and also receive and engage the intermediate portion of the article 100. Second opening 62 may further receive and engage the upper "neck" portion of the articles 100. As described above, openings 58 and 62 of second insert tray 16 are configured to be aligned with openings 42 of first insert tray 14 when both first and second insert trays 14 and 16 are received within carton 12. Second insert tray 16 may be slid downward along the height of the articles 100 until the primary openings 58 engage the transition region between the upper neck portion of the articles 100 and the lower base portion of the articles 100. The smaller diameter of the secondary openings 62 allow the second insert tray 16 to engage the neck portion of the articles 100 and provide a stable, interference fit therebetween while the larger diameter of the primary openings 58 simultaneously provide a stable, interference fit between the base portion of the articles 100. Further, because the lower base panel 46 of second insert tray 16 has approximately the same size and shape as the outer carton 12, the sidewalls 54 and folded end panels 50 of second insert tray 16 engage the perimeter sidewalls 28 of outer carton 12 and thereby restrict second insert tray 16 from moving or sliding within outer carton 12.

As further best illustrated in FIG. 2, upwardly folded end panels 50 of second insert tray 16 may extend above top wall 57 a height approximately equal to the height of carton sidewall 26 between the upper edge of top wall 57 and the upper edge of outer carton 12. In addition, as further shown in FIG. 2, first side panel sections 76 and second side panel sections 78 of each end panel 50 extend in different directions within the interior volume of outer carton 12 so provide increased structural strength to second insert tray 16, which can further assist in restricting second insert tray 16 and the articles 100 secured and constrained by second insert tray 16 from moving or sliding within outer carton 12.

The resulting arrangement of outer carton 12, first insert tray 14, and second insert tray 16 allows packaging container 10 to hold the plurality of articles 100 in an isolated and stable arrangement and prevent articles 100 from movement and damage during shipping, transportation, and/or storage. Further, the configuration of packaging container 10 allows for an efficient use of material in order to allow for a stable arrangement of the plurality of individual articles 100 within packaging container 10.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention.

What is claimed is:

1. A packaging container comprising:

an outer carton comprising a bottom panel and a perimeter sidewall defining an interior volume within the outer carton;

a first insert tray comprising a base panel and a plurality of openings defined through said base panel; and a second insert tray comprising a lower base panel, a top wall generally parallel to and spaced apart from said lower base panel, a plurality of primary openings defined through said lower base panel, and a plurality of secondary openings defined through said top wall, wherein said secondary openings are generally aligned with said primary openings;

wherein said second insert tray further comprises an end panel foldably connected to a perimeter edge of said lower base panel and extending upwardly therefrom, wherein said end panel extends upwardly beyond said top wall;

wherein said first insert tray and said second insert tray are configured to be inserted into said outer carton and received within said interior volume of said outer carton;

wherein said openings of said first insert tray and said primary openings and said secondary openings of said second insert tray are configured to receive one or more articles and secure the one or more articles in an isolated and stable arrangement within said interior volume of said outer carton.

2. The packaging container of claim 1, wherein each of said plurality of openings of said first insert tray is aligned along a vertical axis with a corresponding one of said plurality of primary openings and a corresponding one of said plurality of secondary openings when said first insert tray and said second insert tray are received within said interior volume of said outer carton.

3. The packaging container of claim 1, wherein said base panel of said first insert tray and said lower base panel of said second insert tray each have a length and a width approximately equal to a length and width of said bottom panel of said outer carton.

4. The packaging container of claim 1, wherein said top wall of said second insert tray comprises a first top wall section and a second top wall section secured together in an overlapped arrangement.

5. The packaging container of claim 4, wherein each of said first and second top wall sections is foldably connected to said lower base panel by a sidewall panel extending between said top wall and said lower base panel.

6. The packaging container of claim 1, wherein said end panel includes a locking tab, wherein said locking tab is configured to be received within a receiving slot defined through said top wall.

7. The packaging container of claim 6, wherein said receiving slot is intermediately located within said top wall between two of said plurality of secondary openings.

8. The packaging container of claim 1, wherein said end panel comprises a main panel section extending from said lower base panel, a pair of first panel sections foldably connected to each side edge of said main panel section, and a pair of second panel sections foldably connected to each of said first panel sections.

9. The packaging container of claim 8, wherein said pair of second panel sections include a locking tab extending from a bottom edge thereof and configured to be received within a receiving slot located on said top wall.

10. The packaging container of claim 8, wherein said end panel further comprises a second locking tab extending from each of said pair of panel sections and configured to be received within a second receiving slot located along a perimeter edge of said top wall.

11. The packaging container of claim 1, wherein said first insert tray includes a side panel foldably connected to each longitudinal edge of said base panel, wherein each said side panel includes a sidewall panel section and a bottom wall panel section, wherein said bottom wall panel sections are secured in an overlapping arrangement below said base panel.

12. The packaging container of claim 1, wherein said first insert tray includes an end panel foldably connected to said base panel and extending downwardly below said bottom wall panel sections.

13. The packaging container of claim 1, wherein the one or more articles are beverage bottles.

14. The packaging container of claim 1, wherein the outer carton, the first insert tray, and the second insert tray are constructed from a paperboard material.

15. A packaging container for transporting beverage containers, said packaging container comprising:

an outer carton comprising a bottom panel and a perimeter sidewall defining an interior volume within said outer carton;

a first insert tray comprising a base panel having length and width approximately equal to said bottom panel of said outer carton, wherein said first insert tray includes a plurality of openings defined through said base panel; and a second insert tray comprising a base panel having a length and width approximately equal to said bottom panel of said outer carton, and an overlapping top panel that is spaced apart from and overlays said base panel, wherein said base panel includes a plurality of primary openings defined through said base panel and a plurality of secondary openings defined through said overlapping top panel, wherein said secondary openings are generally aligned with said primary openings;

wherein said second insert tray further comprises an end panel extending upward from said base panel and above said overlapping top panel;

wherein said first insert tray and said second insert tray are configured to be inserted within said interior volume of said outer carton, and wherein said openings of said first insert tray and said primary openings and said secondary openings of said second insert tray are configured to receive one or more beverage containers; and wherein said first insert tray and said second insert tray are configured to secure the one or more beverage containers in an isolated and stable arrangement within said outer carton.

* * * * *